US006893383B1

(12) United States Patent
Chang et al.

(10) Patent No.: US 6,893,383 B1
(45) Date of Patent: May 17, 2005

(54) STEPPER

(75) Inventors: Chih Yuan Chang, Taichung Hsien (TW); Jian Sen Wang, Taichung (TW)

(73) Assignee: Alilife Industrial Co., Ltd., Taichung (TW)

( * ) Notice: Subject to any disclaimer, the term of this patent is extended or adjusted under 35 U.S.C. 154(b) by 0 days.

(21) Appl. No.: 10/778,035

(22) Filed: Feb. 17, 2004

(51) Int. Cl.[7] ..... A63B 22/64; A63B 22/00
(52) U.S. Cl. ..... 482/54; 482/52
(58) Field of Search ..... 482/51–54, 148

(56) References Cited

U.S. PATENT DOCUMENTS 5,336,146 A * 8/1994 Piaget et al. ..... 482/54
5,626,539 A * 5/1997 Piaget et al. ..... 482/54
5,669,856 A * 9/1997 Liu ..... 482/51
6,811,519 B2 * 11/2004 Kuo ..... 482/54

* cited by examiner

*Primary Examiner*—Stephen R. Crow
(74) *Attorney, Agent, or Firm*—Rosenberg, Klein & Lee

(57) ABSTRACT

A stepper includes a base and two stands upwardly extending from a front portion of the base. Two swing arms are respectively pivotally connected to a rear portion of the base due to a pivot structure that is mounted in a corresponding one of the two swing arms. Each swing arm has an endless strap sleeved thereon for user to step thereon. A drive shaft pivotally extends through the pivot structures for driving the straps and supporting the two swing arms. A motor is mounted on the base for driving the drive shaft. A restitution structure is mounted under a corresponding one of the two swing arms for providing a restitution force to the corresponding swing arm after being downward stepped.

4 Claims, 6 Drawing Sheets

STEPPER

BACKGROUND OF THE INVENTION

1. Field of the Invention

The present invention relates to stepper, and more particularly to a stepper that includes two endless straps respectively mounted on to two swing arms of the stepper.

2. Description of Related Art

A conventional stepper in accordance with the prior art shown in FIG. 5 comprises a main frame (61) including a base (611) adapted to abut a supporting surface, two stands (612) respectively upwardly extending from two opposite sides of a front portion of the base (611) and a hand post (613) mounted on a free end of each of the two stands (612). Two swing arms (62) are pivotally mounted to a rear portion of the base (611). The two swing arms (62) are parallel to each other and swung opposite to each other. Each swing arm (62) has a rear end pivotally mounted to the rear portion of the base (611) and a front end having an air spring (63) mounted thereon. The air spring (63) has a first end pivotally connected to the front end of a corresponding one of the two swing arms (62) and a second end pivotally mounted to an inner side of a corresponding one of the two stands (612). Each swing arm (62) has an endless strap (621) movably sleeved thereon for user to step on the swing arms (62). A motor (64) is mounted to a rear end of the base (611) for driving the two endless straps (621).

The two air springs (63) are provided to respectively provide a restitution force to two swing arms (62) after being downward stepped. However, each air spring (63) only mounted to one side of each of the two swing arms (62) so that the load of each of the two swing arms (62) is not average. Furthermore, the motor (64) is mounted to the rear portion of the base (611) so that the total length of the stepper is elongated.

For solving the above problem, the motor (64) is mounted under the two swing arms (62) and each side of each of the two swing arms (62) has at least one air spring (65) mounted on each of the two swing arms (62). As a result, the stepper should have at least four air springs for balancing the load from the two swing arms (62). Consequently, the manufacturing cost is raised.

The present invention has arisen to mitigate and/or obviate the disadvantages of the conventional steppers.

SUMMARY OF THE INVENTION

The main objective of the present invention is to provide an improved stepper that has shortened total length and a good balance.

To achieve the objective, the stepper in accordance with the present invention comprises a main frame including a base and two stands respectively upwardly extending from two opposite sides of a front portion of the base. Two swing arms are respectively pivotally mounted to a rear portion of the base. Two restitution structures are respectively pivotally to a bottom of a corresponding one of the two swing arms for providing a restitution force to the corresponding swing arm. Each swing arm has a pivot structure mounted in a rear end of each of the two swing arms and an endless strap is sleeved thereon. A drive shaft extends through the pivot structure of each of the two swing arms for supporting the two swing arms and driving the endless strap of each of the two swing arms. Multiple supports upwardly extend from the rear portion of the base for supporting the drive shaft. A motor is mounted on the base for driving the drive shaft. A restitution structure is pivotally mounted to a bottom of each of the two swing arms. The restitution structure includes an air spring and rack. The air spring has a first end pivotally connected to the base and a second end pivotally connected to the bottom of a corresponding one of the two swing arms. The rack has a first end slidably mounted to the base and a second end pivotally connected to the bottom of the corresponding swing arm. The first end of each of the two restitution structures has two opposite sides respectively slidably received in a rectangular casing that is laterally attached to the base.

Further benefits and advantages of the present invention will become apparent after a careful reading of the detailed description with appropriate reference to the accompanying drawings.

DETAILED DESCRIPTION OF THE INVENTION

Figure 1:
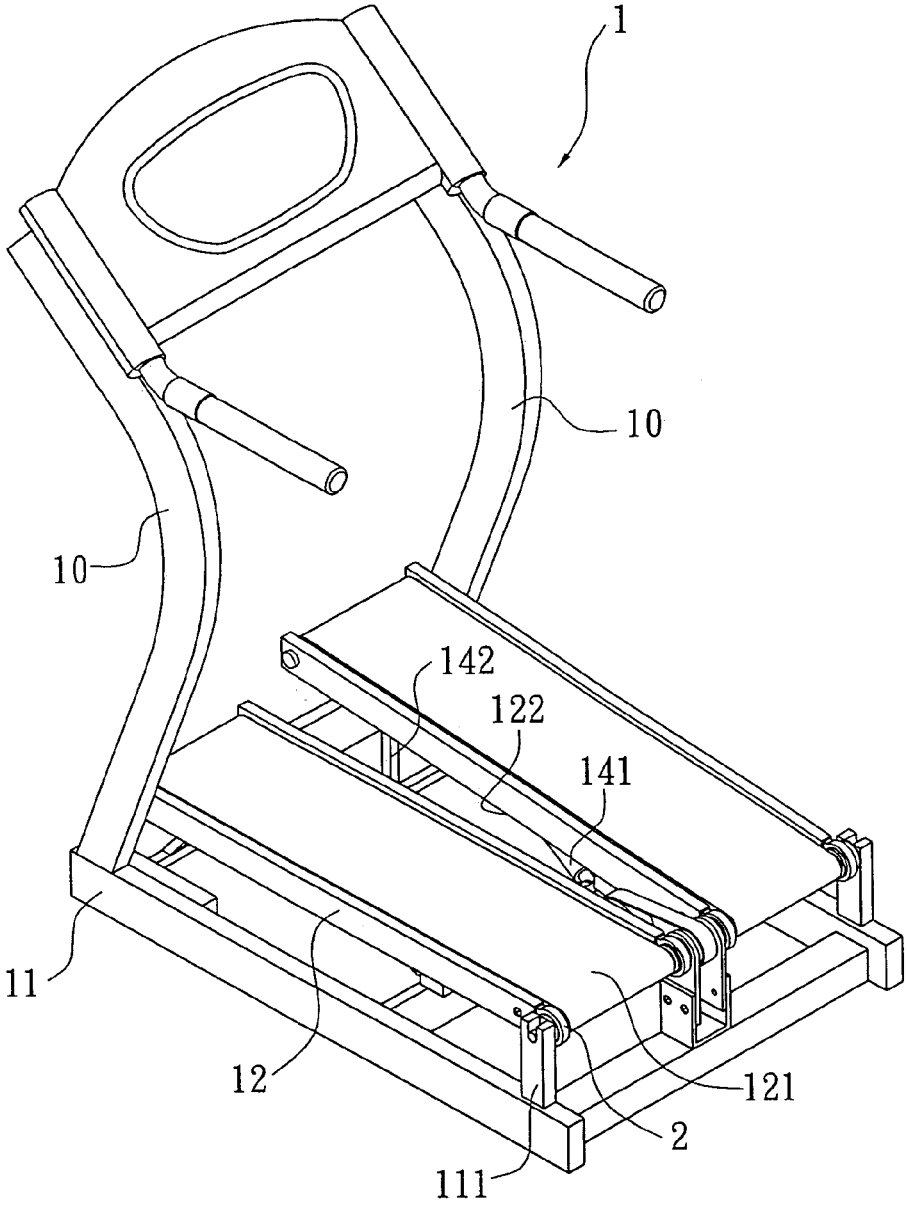
FIG. 1 is a perspective view of a stepper in accordance with the present invention.
Figure 2:
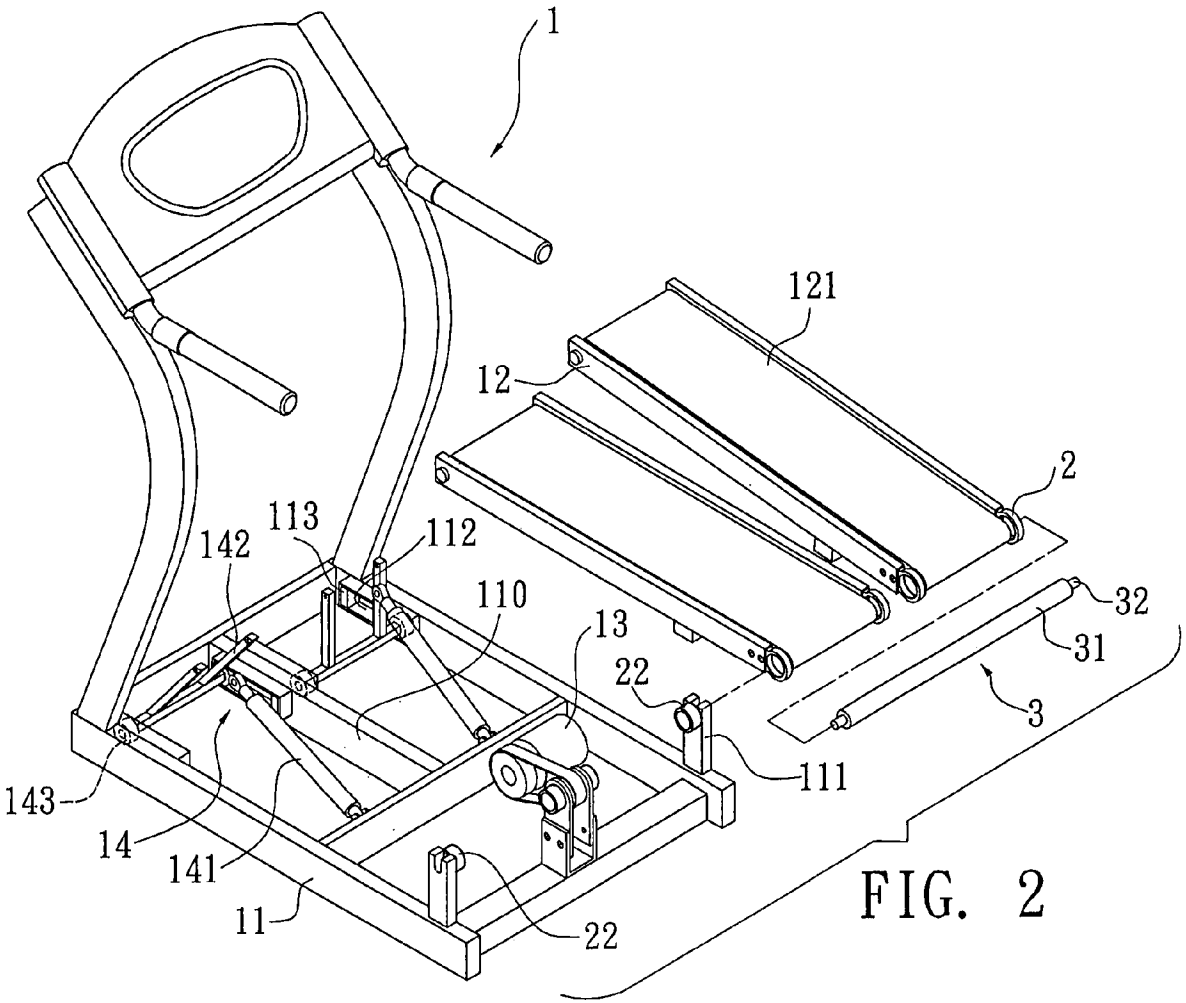
FIG. 2 is a partially exploded perspective view of the stepper in FIG. 1.
Figure 3:
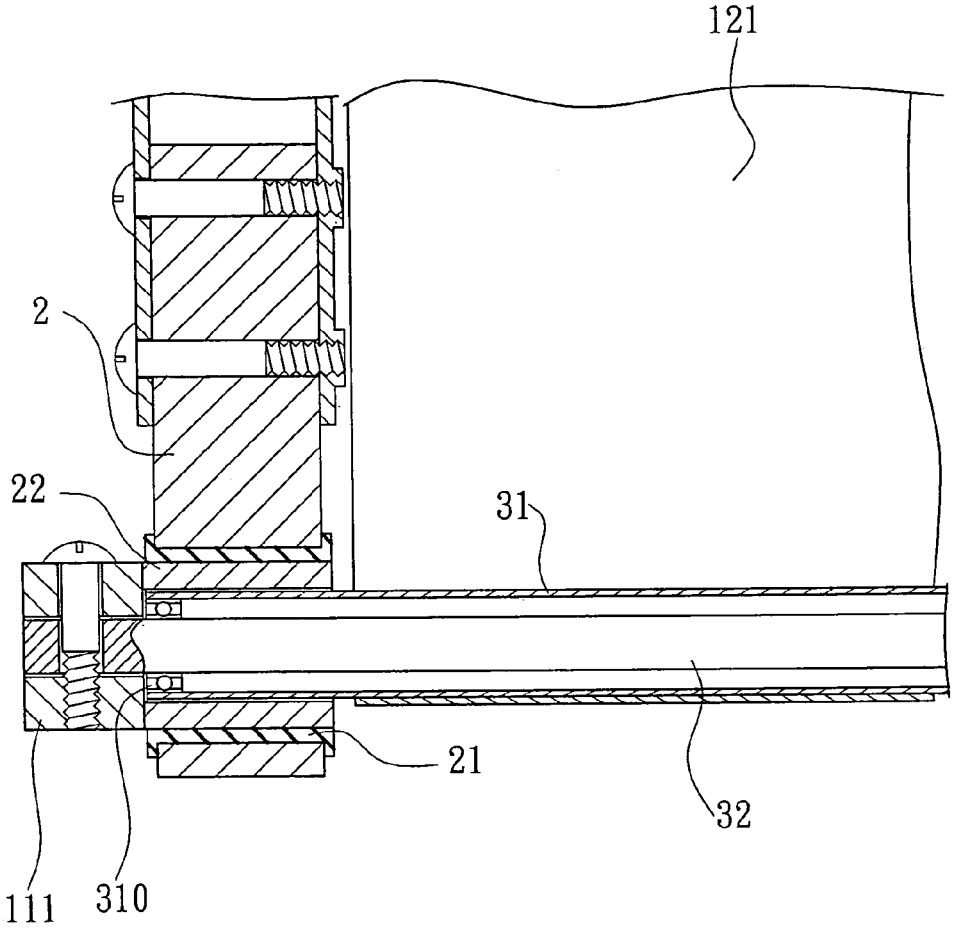
FIG. 3 is a partial top plan view in cross-section of the stepper in FIG. 1.

Referring to the drawings and initially to FIGS. 1–3, a stepper in accordance with the present invention comprises a main frame (1) including a base (11) and two stands (10) respectively upwardly extending from tow opposite sides of a front portion of the base (11). Two swing arms (12) are respectively pivotally mounted to a rear portion of the base (11) due to a pivot structure (2) mounted therein.

The base (11) has two side rods (not numbered) parallel to each other and two lateral rods (not numbered) respectively connected a front end of each of the two side rods and the middle portion of each of the two side rods. A partition (110) has two opposite ends respectively secured on the two lateral rods to equally divided the base (11) into two portions each corresponding to a corresponding one of the two swing arms (12). The inner side of each of the two side rods and two opposite sides of the partition (110) each has a rectangular casing (112) laterally longitudinally secured on the front portion of the base (11). Each rectangular casing (112) has two opposite ends each having a cushion pad (143) therein. A support (111) upwardly extends from a rear end of each of the side rods. Each swing arm (12) has an endless strap (121) mounted around the swing arm (12) and a bottom (122) for protecting the strap (121) from being broken by the elements that is mounted under the two swing arms (12). A motor (13) is mounted on the rear portion of the base (11) to drive the two straps (121) for user to step thereon.

The pivot structure (2) includes a lining (21) securely inserted into two opposite sides of a rear end of each of the two swing arms (12) and a sleeve (22) laterally attached to a corresponding one of the two supports (111) and inserted into a corresponding one of the four linings (21). A drive shaft (3) pivotally extends through the sleeves (22) for supporting the rear end of each of the two swing arms (12).

The drive shaft (3) includes an axle (32) having two opposite ends respectively secured in the two supports (111) and a cylinder (32) rotatably sleeved on the axle (32) and partially secured in the sleeves (22) of the two swing arms (12). A motor (13) is mounted on the rear portion of the base (11) for driving the cylinder (31) and the two straps (121) of the two swing arms (12).

Two restitution structures (14) are respectively mounted to two opposite sides of the front portion of the base (11) relative to the partition (110). Each restitution structure (14) provides a restitution force to a corresponding one of the two swing arms (12) after being downward stepped. Each restitution structure (14) includes an air spring (141) having a first end pivotally connected to the lateral rod relative to the rear portion of the base (11) and a second end pivotally extending to the bottom (122) of a corresponding one of the two swing arms (12), and a rack (142) having a first end pivotally connected to the front portion of the base (11) and a second end pivotally connected to the bottom (122) of the corresponding one of the swing arms (12). The first end of each of the two racks (142) has two opposite ends each having a roller (143) rotatable mounted thereon and slidably received in a corresponding one of the four rectangular casings (112).

Figure 4:
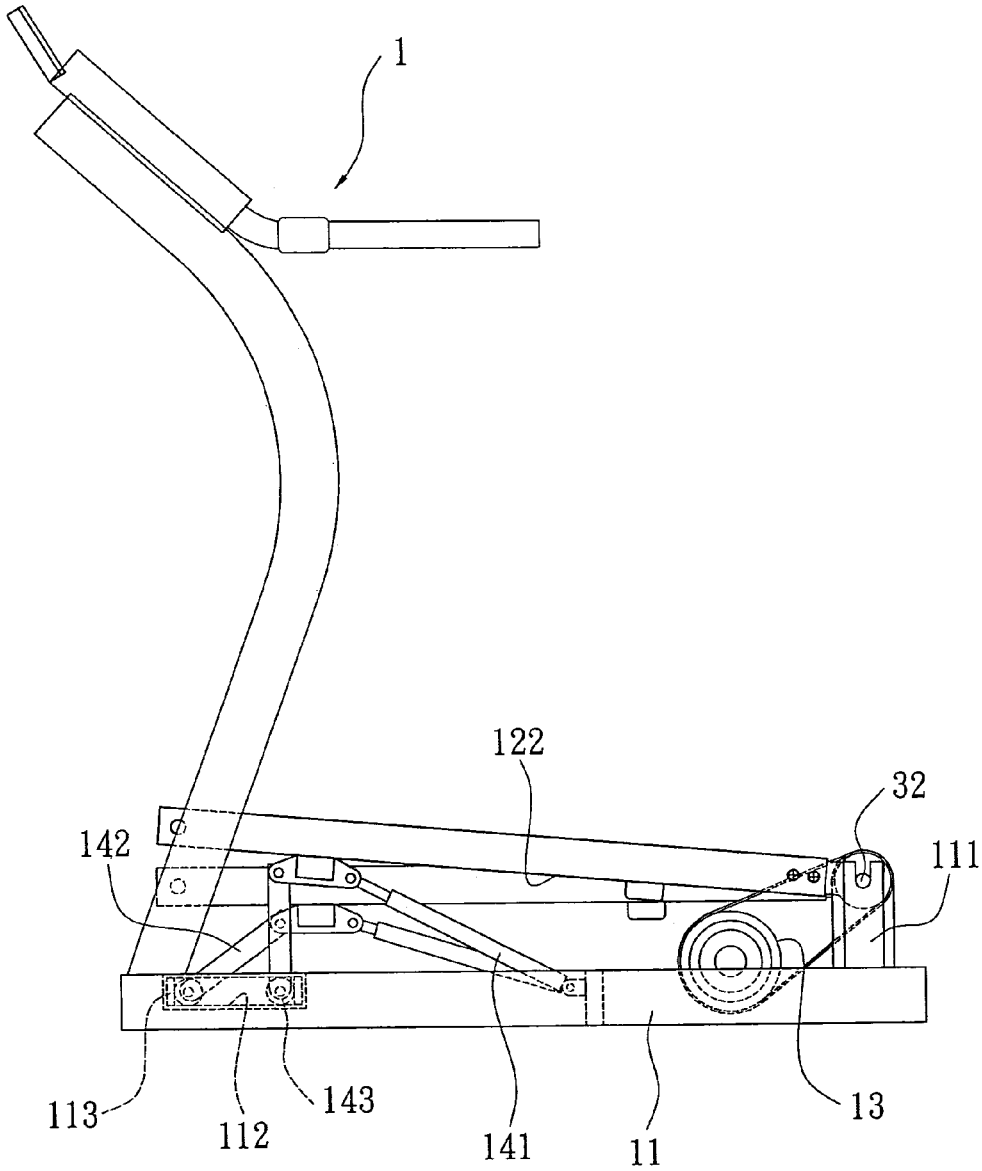
FIG. 4 is a side plan view of the stepper in FIG. 1.
Figure 5:
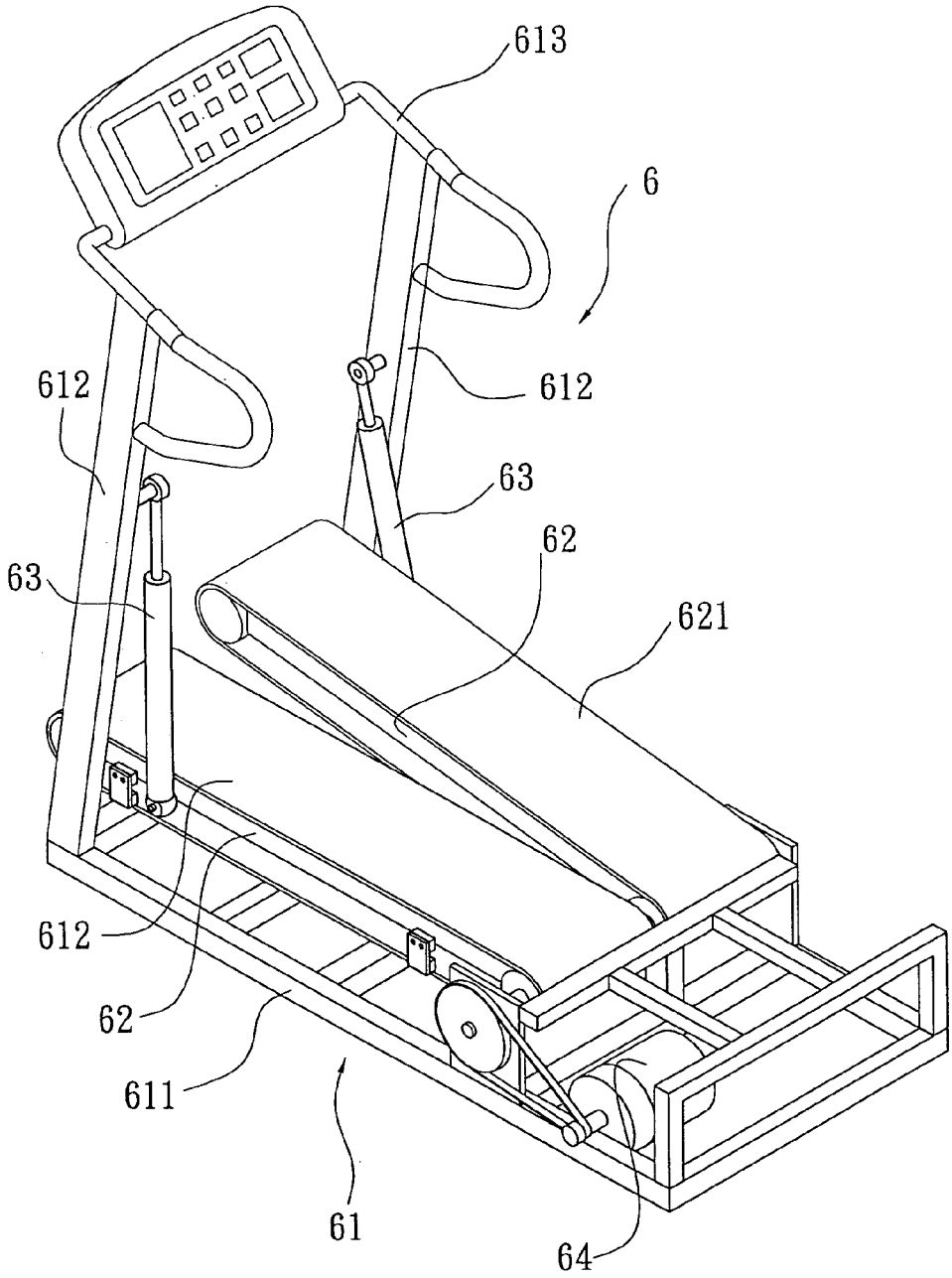
FIG. 5 PRIOR ART
FIG. 5 is a perspective view of a conventional stepper in accordance with the prior art.
Figure 6:
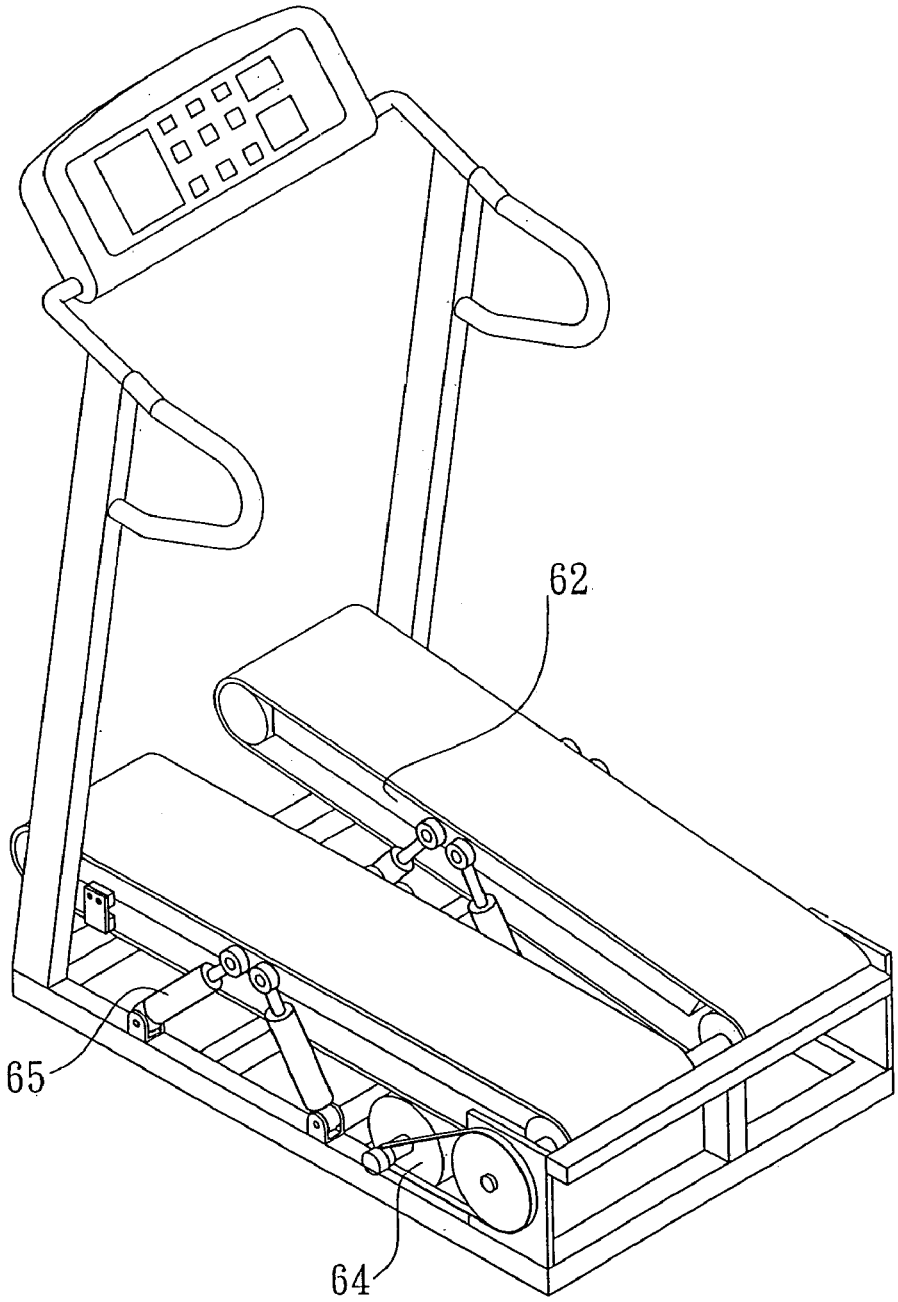
FIG. 6 PRIOR ART
FIG. 6 is a perspective view of a second embodiment of the conventional stepper in FIG. 5.

With reference to FIG. 4, the roller (143) is moved to a front end of each of the four rectangular casings (112) and the air spring (141) is compressed when the front end of the swing arm (12) is downward stepped. The roller (143) is moved to a rear end of each of the rectangular casings (112) and the rack (142) lifts the front end of the swing arm (12) due to the restitution force of the air spring (141) when the action is removed from the swing arm (12) or smaller than the restitution force of the air spring (141). Consequently, the user can repeatedly step on the two swing arms (12) for achieving a purpose of exercise. The two cushion pads (113) in each of the four rectangular casings (112) can absorb some of the attack from the roller (143) to prevent the stepper from a vibration.

In addition, the stepper in accordance with the present invention only needs two air springs (141) that are respectively provide a restitution force to a corresponding one of the two swing arms (12). Consequently, the stepper of the present invention can use least air springs and provide a better balance than that of the conventional steppers.

Although the invention has been explained in relation to its preferred embodiment, it is to be understood that many other possible modifications and variations can be made without departing from the spirit and scope of the invention as hereinafter claimed.

What is claimed is:

1. A stepper comprising a main frame including a base and two stands respectively upwardly extending from two opposite sides of a front portion of the base, two swing arms respectively pivotally mounted to a rear portion of the base, two restitution structures respectively pivotally mounted to a bottom of a corresponding one of the two swing arms for providing a restitution force to the corresponding swing arm, each swing arm having a pivot structure mounted in a rear end of each of the two swing arms and an endless strap sleeved thereon, a drive shaft extending through the pivot structure of each of the two swing arms for supporting the two swing arms and driving the endless strap of each of the two swing arm, multiple supports upwardly extending from the rear portion of the base for supporting the drive shaft, a motor mounted on the base for driving the drive shaft, said restitution structures including an air spring and rack, the air spring having a first end pivotally connected to the base and a second end pivotally connected to the bottom of a corresponding one of the two swing arms, the rack having a first end slidably mounted to the base and a second end pivotally connected to the bottom of the corresponding swing arm, the first end of each of the two restitution structures having two opposite sides respectively slidably received in a rectangular casing that is laterally attached to the base.

2. The stepper as claimed in claim 1, wherein the rectangular casing comprises two opposite ends each having a cushion pad mounted thereon for absorbing the vibration from the stepper during operating.

3. The stepper as claimed in claim 1, wherein the motor is mounted under the two swing arms for reducing the total length of the stepper.

4. The stepper as claimed in claim 1, wherein the pivot structure comprises two lining respectively inserted into two opposite sides of a rear end of each of the two swing arms and multiple sleeve laterally mounted to the multiple supports and inserted into a corresponding one of the linings.

* * * * *